US007415799B2

(12) United States Patent
Morris

(10) Patent No.: US 7,415,799 B2
(45) Date of Patent: Aug. 26, 2008

(54) BUILDING COMPONENT

(76) Inventor: Benedict George Morris, 66 Brooke Road, London N16 7RU (GB)

( * ) Notice: Subject to any disclaimer, the term of this patent is extended or adjusted under 35 U.S.C. 154(b) by 0 days.

(21) Appl. No.: 11/588,936

(22) Filed: Oct. 27, 2006

(65) Prior Publication Data

US 2007/0039249 A1 Feb. 22, 2007

Related U.S. Application Data

(62) Division of application No. 10/403,466, filed on Mar. 31, 2003, now Pat. No. 7,127,851.

(30) Foreign Application Priority Data

Apr. 2, 2002 (GB) ..... 0207643.8

(51) Int. Cl.
*E04B 1/34* (2006.01)

(52) U.S. Cl. ..... 52/2.11; 52/232; 52/22; 52/2.26; 52/2.22

(58) Field of Classification Search ..... 52/2.11, 52/2.18, 2.22, 2.24, 2.26, 232; 83/651.1, 83/171; 49/7, 8

See application file for complete search history.

(56) References Cited

U.S. PATENT DOCUMENTS

| | | | | |
|---|---|---|---|---|
| 3,996,650 | A | 12/1976 | Tonn | |
| 4,114,325 | A | 9/1978 | Hochstein | |
| 4,807,405 | A | 2/1989 | Borgquist | |
| 4,878,322 | A | 11/1989 | Ikeda et al. | |
| 5,027,564 | A | 7/1991 | Lechner | |
| 6,082,385 | A | 7/2000 | Burford et al. | |
| 6,161,348 | A * | 12/2000 | Morris | 52/232 |
| 6,199,337 | B1 | 3/2001 | Colson et al. | |

FOREIGN PATENT DOCUMENTS

| | | |
|---|---|---|
| EP | 0021834 A1 | 1/1981 |

* cited by examiner

*Primary Examiner*—Basil Katcheves
(74) *Attorney, Agent, or Firm*—Greenberg Traurig LLP

(57) ABSTRACT

A building component for forming a roof. The component includes an ETFE foil cushion comprising sheets of ETFE foil which are held in a frame about their periphery, and which are inflated. The frame includes a release mechanism for releasing the cushion from the frame, for example, in the event of a fire.

5 Claims, 4 Drawing Sheets

BUILDING COMPONENT

RELATED APPLICATION

This divisional application claims priority to and the benefit of U.S. application Ser. No. 10/403,466, filed on Mar. 31, 2003 now U.S. Pat. No. 7,127,851, which, in turn, claims priority to and the benefit of United Kingdom patent application number 0207643.8, filed on Apr. 2, 2002, which applications are herein incorporated by reference in their entirety.

BACKGROUND

The present invention relates generally to building components and, more particularly, but not exclusively, to building components for roofing, in the form of inflatable cushions.

Inflatable cushions comprise two or more layers of a plastic foil material such as ETFE (ethylene tetra flouro ethylene) inflated with low pressure air. The ETFE foil cushion is restrained in a perimeter frame usually manufactured from extruded aluminium, which in turn is fixed to a support structure. As the ETFE foil cushion is inflated, the ETFE is put under tension and forms a tight drum like skin. ETFE foil cushions are sold under a number of trade names, for example "Texlon."

ETFE cushions of this kind are fixed to a support structure to form a cladding and are used to enclose atria or other enclosed spaces to provide a transparent or translucent roof or façade to the enclosure, as an alternative to and in a similar way to glass. A number of buildings have been built using this technology most notably the Eden project in Cornwall, England.

Whenever a space is enclosed by a cladding system due consideration needs to be given to the effects of a fire should it break out in the building. In these circumstances, smoke and other products of combustion must be ventilated from the enclosure to prevent injury to the occupants and property. In some specialist buildings, other noxious fumes may also need to be ventilated from the enclosure to prevent injury to the occupants and property. In some specialist buildings, other noxious fumes may also need to be ventilated to atmosphere.

To ventilate noxious fumes to atmosphere, two methods are primarily utilized. Firstly, the smoke, and/or fumes can be extracted by a mechanical extraction system usually consisting of fire-rated duct work and extraction fans. Alternatively, the smoke and/or fumes can be extracted by opening part of the roof or building façade and allowing the smoke to ventilate to atmosphere through the action of convection and/or wind.

ETFE foil cushions can be used to ventilate smoke and/or fumes to the atmosphere in much the same ways as other cladding systems in that they can be fixed to a frame which opens automatically through a mechanical device in the event of fire. In addition, ETFE is a thermo-plastic material and therefore has the innate property of failing if the temperature reaches approximately 200° C., as the material loses its tensile properties as its temperature increases. When the cushion fails, it allows smoke and/or fumes to ventilate naturally to the atmosphere.

The above methods suffer from a number of draw backs. The mechanical extraction approach is expensive and requires fire-rated machinery, regular maintenance and testing. Natural extraction requires expensive opening frames, which are complex to render, weather and watertight. They do not look the same as the adjacent cladding as they require a secondary opening frame, and mechanical operating parts which themselves require regular maintenance and testing.

The failure of the ETFE due to high temperature does not occur if the building fire is located some way away from the ETFE, as the ETFE is not sufficiently heated by smoke and/or fumes to fail.

SUMMARY OF THE INVENTION

It is an object of the present invention to provide an economical, visually unobtrusive, method of causing ETFE foil cladding systems to fail on demand in order to allow natural smoke ventilation from a building enclosure.

It is a further object of the invention to allow the system to fail on demand in order to shed high loads such as snow or water ponding.

Thus, according to one aspect, the present invention provides a building component in the form of an inflatable cushion comprising two or more sheets of plastics foil and a relatively rigid frame surrounding and supporting the foil sheets, the building component further incorporating a release mechanism in or adjacent to the frame arranged to release the foil sheets from the frame.

Preferably, the sheets are made from ethylene tetrafluoro ethylene (ETFE). Preferably, the sheets define a space between them which is inflated with air and the frame restrains the sheets about their perimeters, thereby forming the cushion. The release mechanism may extend the entire periphery of the cushion. Alternatively, it may extend only part of the way around, for example, in the case of a polygonal cushion, it may extend around all sides except one. In the case of a rectangular cushion, therefore, it might extend around three sides.

Preferably, the cushion has a bead formed around its periphery, and the bead is located within the frame. The bead may be a rope encapsulated by the sheet material. The bead may be held by a keder edge within the frame.

The frame may be manufactured from extruded aluminium which, in turn, may be fixed to a support structure. The frame preferably incorporates a device which releases the ETFE foil cushion from the frame in the event of fire so allowing the smoke to ventilate to atmosphere.

For releasing the ETFE foil cushion from the frame two exemplary means may be employed, namely, mechanically releasing the cushion or cutting it free.

In the case of mechanical release, this may be achieved by either extracting the rope from the bead which restrains the ETFE foil cushion in the frame, or by hinging a part of the frame so that it releases the keder edge. Preferably, therefore, the release mechanism comprises a device which removes the rope from the bead on demand, releasing the ETFE foil cushion from the frame. Suitable means for removing the rope include, by way of example, a mechanical winch, or ram, block and tackle. This can be done via a turning wheel. Alternatively, the release mechanism may comprise a hinged member engaging the cushion, the hinged member being movable on demand to a position in which it does not engage the cushion, thereby releasing the cushion from the frame.

In the case of cutting the cushion free, preferably, the frame incorporates a cutting device which either physically cuts or melts the ETFE foil along the edge of the cushion. Preferably, therefore, the release mechanism comprises an electrical resistance cable which causes the edge of the cushion to melt on demand, releasing the ETFE foil cushion from the frame. Alternatively, the release mechanism may comprise a cutting blade adjacent to the perimeter frame, and a means for moving the cutting blade so that on demand, the blade moves, cutting the ETFE foil cushion, thereby releasing the ETFE foil cushion from the frame. The cutting blade can be situated either above or below the inflated cushion. Suitable means for moving the blade include a mechanical winch, ram or block and tackle.

Whichever mechanism is used for releasing the ETFE foil cushion from the frame, on release from the frame, the ETFE cushion moves away from the frame so allowing the products of combustion or other noxious fumes to ventilate to atmosphere. On operation of the release mechanism on one or more sides, the ETFE foil cushion may form a cylindrical or spherical shape due to retention of pressurized air in the cushion; flap or fall away from one or more sides of the frame; or flap or fall away from all sides of the frame. In any event, the removal of the cushion from all or part of the frame will allow smoke or noxious fumes to ventilate from the building. It will also allow any excessive water or snow loads to be released.

A better understanding of the objects, advantages, features, properties and relationships of the invention will be obtained from the following detailed description and accompanying drawings which set forth illustrative embodiments which are indicative of the various ways in which the principles of the system and method may be employed.

BRIEF DESCRIPTION OF THE DRAWINGS

For a better understanding of the invention, reference may be had to preferred embodiments shown in the following drawings in which.

DETAILED DESCRIPTION

Figure 1:
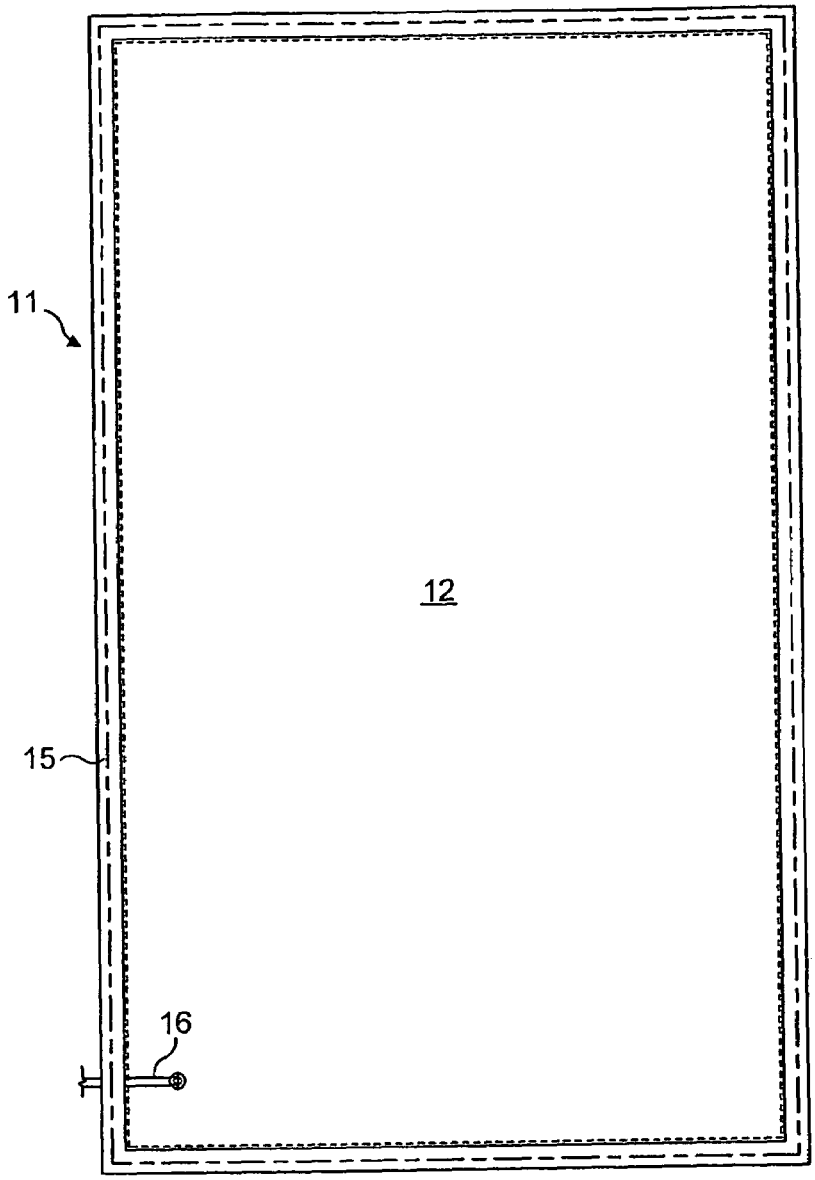
FIG. 1 is a plan of an exemplary ETFE cushion constructed in accordance with the present invention.
Figure 2:
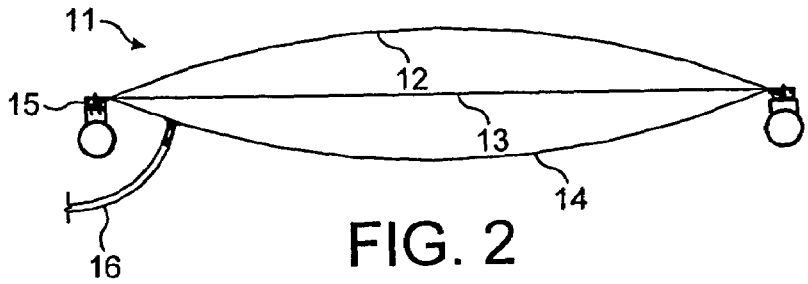
FIG. 2 is a cross section through the assembly of FIG. 1.

Turning now to the figures, where like reference numerals refer to like elements, FIGS. 1 and 2 show an exemplary ETFE cushion constructed in accordance with the invention. The cushion 11 comprises three rectangular ETFE foil sheets 12, 13, 14, a support frame 15 and a plenum 16. The frame 15 is located about the perimeter of the sheets 12, 13, 14 and incorporates a release mechanism. The space between the sheets 12, 13, 14 is inflated with air via the plenum 16.

Figure 3:
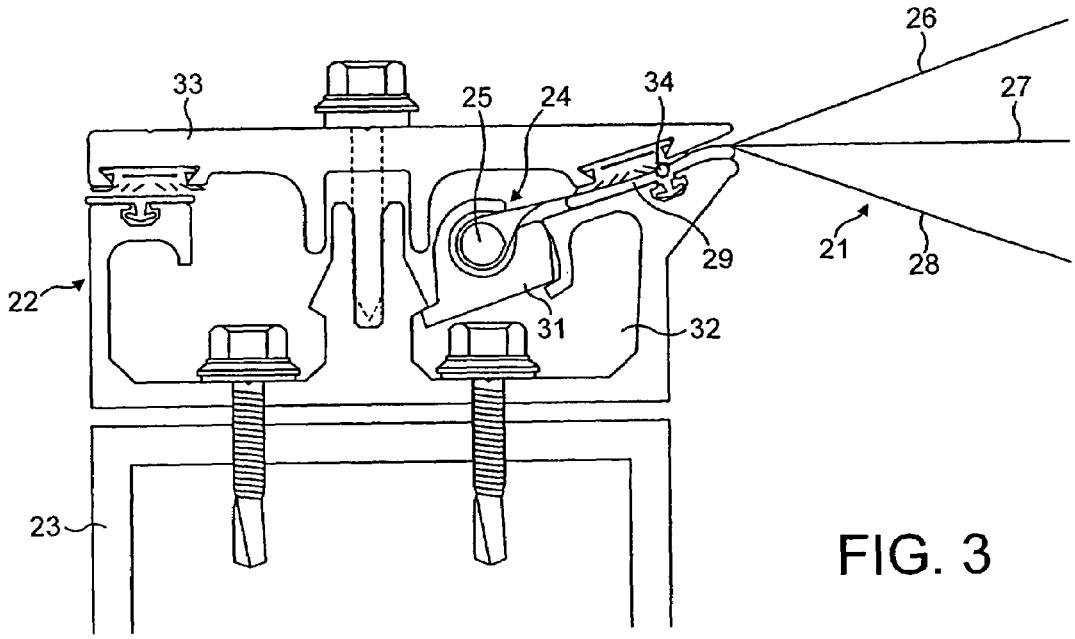
FIG. 3 is a detailed cross section of the perimeter cushion frame showing one embodiment of an exemplary release mechanism.

FIG. 3 shows a first embodiment of an exemplary release mechanism. The overall arrangement comprises a cushion 21, a support frame 22 and a building structure 23. The cushion 21 has a bead 24 at its perimeter made from a rope 25 encapsulated by an extended portion of the sheets 26, 27, 28. Between the bead 24 and the inflated part of the cushion 21, there is an edge support 29. The bead 24 is captured within a keder edge 31, made from aluminium.

The frame 22 comprises a housing 32 and a cap 33. The keder edge 31 is clipped into the housing 32 and the cap 33 is bolted into the housing 32 to form a weather-tight seal. The housing 32 is itself bolted to the structure 23.

The edge support 29 includes a cable 34, preferably electrically resistant, extending around the perimeter of the cushion 21, or at least around three sides. When required, current may be passed through the cable 34 for the purpose of raising its temperature to a level where the ETFE foil 26, 27, 28 or the support 29 fails and the cushion 21 is freed from the frame 22.

Figure 4:
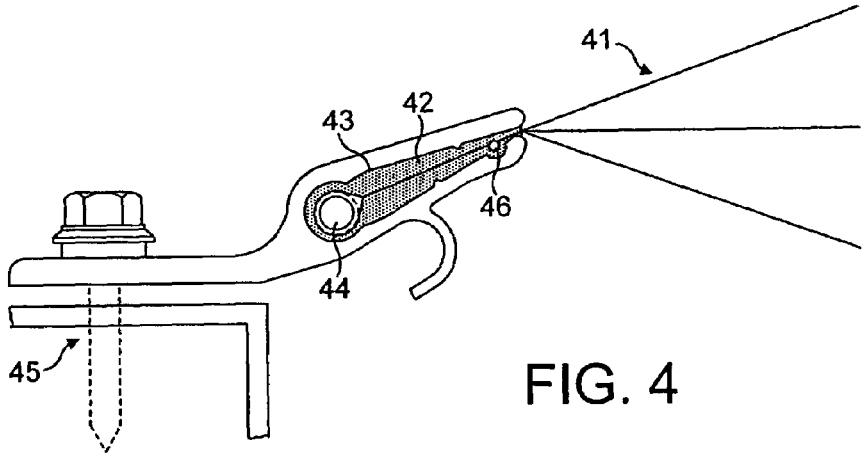
FIG. 4 is a detailed cross section of an alternative perimeter cushion frame showing a variant of the first embodiment of release mechanism.

A further exemplary release mechanism is shown in FIG. 4 which is similar to that of FIG. 3, but in this case, the bead 44 of the cushion 41 is located in a compressible gasket 42 made, for example, of EPDM which is itself swaged into a retaining channel 43 forming part of the frame 45. Again, there is a resistance cable 46 in contact with the foil of the cushion 41 which causes the foil to fail when current is passed through the cable 46.

Figure 5:
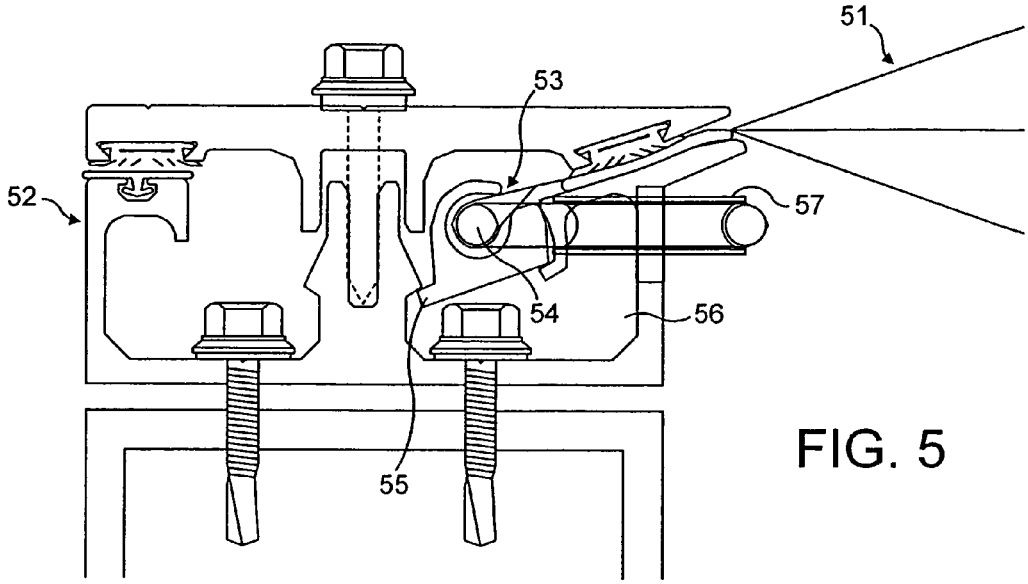
FIG. 5 is a detailed cross section of the perimeter cushion frame showing a second embodiment of an exemplary release mechanism.

A still further exemplary release mechanism is shown in FIG. 5. Again, the cushion 51 is located within the frame 52 by means of a peripheral bead 53 including a rope 54, the bead being captured by a keder edge 55 which is clipped into the frame housing 56. However, in this embodiment, there need not be a resistance cable. Instead, the rope 54 may be wound round a pulley 57 and connected to a winch (not shown). Thus, when required, the rope 54 is drawn by a winch, and the bead 53 collapses. As a result, the cushion 51 is released.

Figure 6:
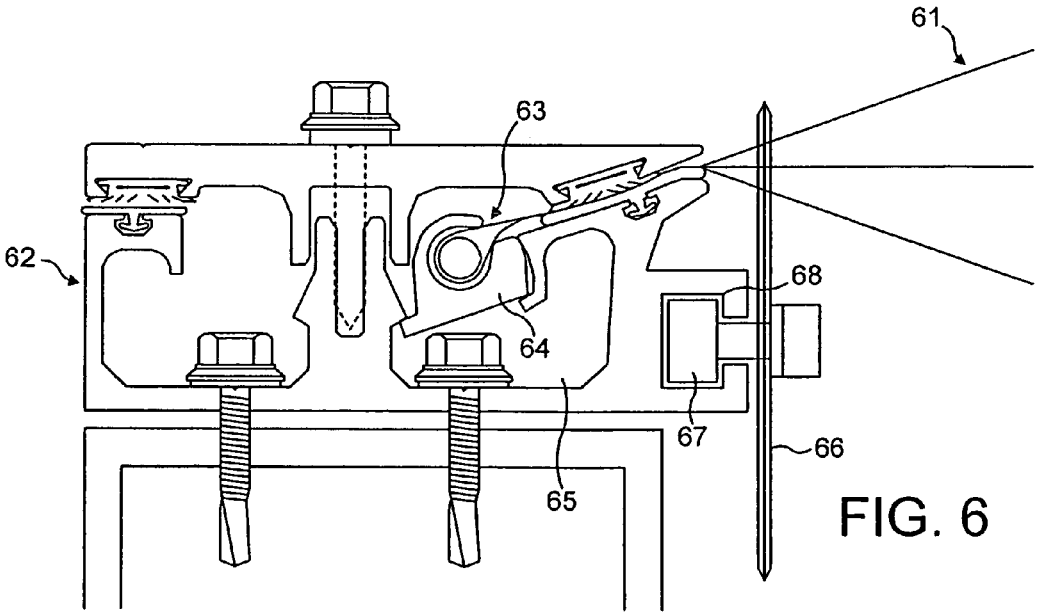
FIG. 6 is a detailed cross section of the perimeter cushion frame showing a third embodiment of an exemplary release mechanism.

Yet another exemplary release mechanism is shown in FIG. 6. In this case, the cushion 61 is located within the frame 62 by means of a peripheral bead 63 captured by a keder edge 54 clipped into the frame housing 65. However, in this embodiment, a blade 66 may be provided on a carriage 67 which is arranged to be rotatable and to travel along a track 68 around at least three sides of the periphery of the cushion 61, when required, cutting through the cushion foils to free the cushion 61. Although the blade 66 is shown located below the cushion it could equally well be above. In the illustrated example, the blade 66 is shown in its deployed position, cutting through the foils. It is to be understood that in its normal position, the blade 66 would not make contact with the foils. When required, the blade 66 would be swung into the deployed position and moved along the cushion 61. There may be a separate blade 66 for each side of the cushion 61.

Figure 7:
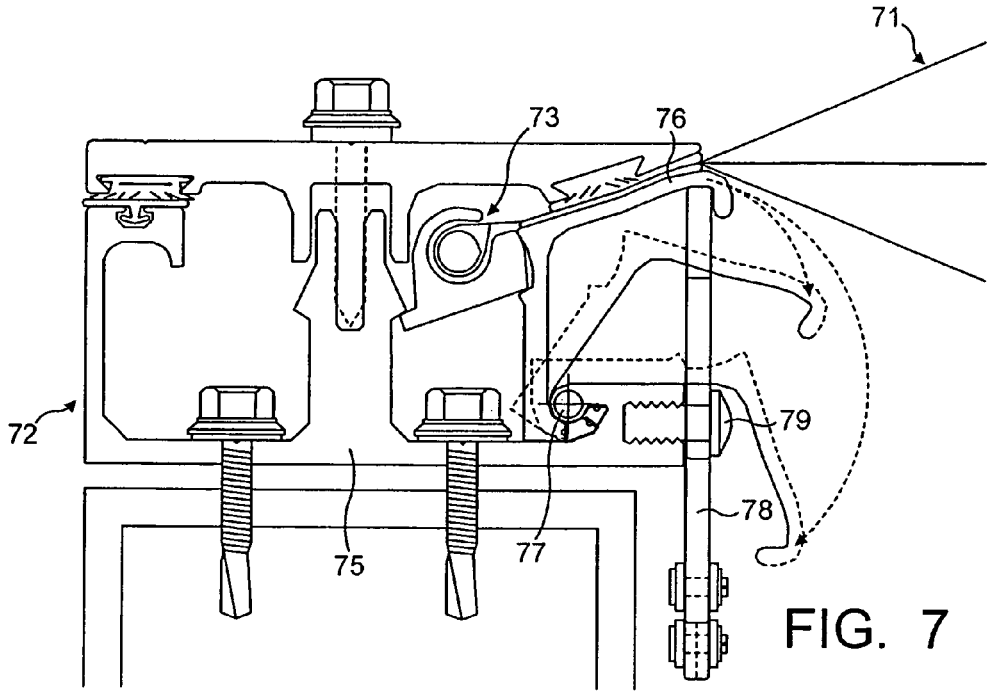
FIG. 7 is a detailed cross section of a perimeter cushion frame showing a fourth embodiment of an exemplary release mechanism.
Figure 8:
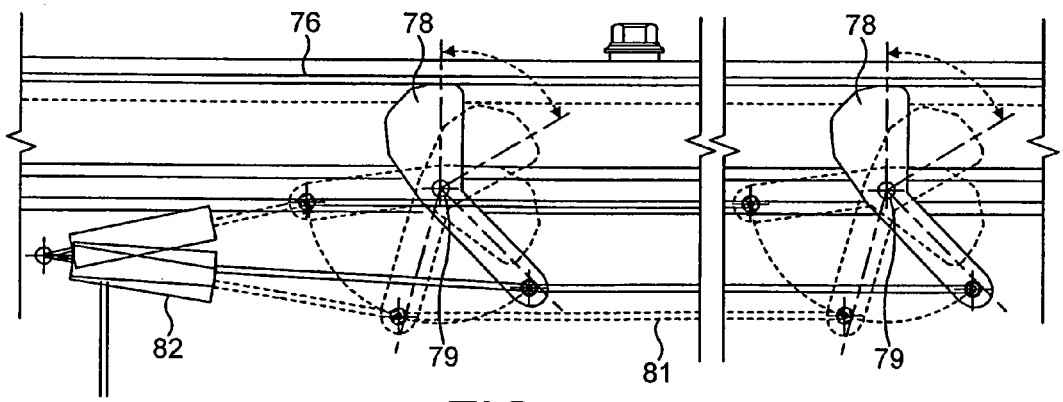
FIG. 8 is an elevation of FIG. 7.

Still further examples of a release mechanism are illustrated in FIGS. 7 and 8. In this case the cushion 71 is located within the frame 72 by means of a peripheral bead 73 captured by a keder edge 74 clipped into the frame housing 75. However, in this embodiment, the foils, between the bead 73 and the inflated part of the cushion 71 are supported on and held along each edge by a hinged member 76 forming part of the housing 75. Each hinged member 76 is pivoted about an axle 77. Each hinged member 76 is held in its normal position, engaging the foils, by a series of levers 78 which are pivotally connected to the frame 72 by pins 79. The levers 78 are connected together by connecting rods 81 and one lever is connected to a pneumatic or hydraulic ram 82. When it is desired to release the cushion 71, the ram 82 associated with each side is operated. This draws the levers 78 towards the ram 82, rotating them clockwise about the pins 79 to the positions shown in broken lines. This in turn allows the hinged member 79 to pivot downwards about the axle 77 to the positions shown in broken lines, so releasing the cushion 71 from the housing 75.

From the foregoing, it will be understood, when the cushion is released, smoke can be ventilated and/or any accumulated excess snow or water loads can be released.

While various embodiments of the invention have been described in detail, it will be appreciated by those skilled in the art that various modifications and alternatives to those details could be developed in light of the overall teachings of the disclosure. For example, it is to be appreciated that the arrangements shown in FIGS. 6 and 7 could be combined, to allow the cushion to be released downwards to the blade. It will also be appreciated that, as with the earlier embodiments, the release mechanism illustrated in FIGS. 7 and 8 can act on three sides or all four sides of the cushion. Accordingly, it will be understood that the particular arrangements and procedures disclosed are meant to be illustrative only and not limiting as to the scope of the invention which is to be given the full breadth of the appended claims and any equivalents thereof.

What is claimed is:

1. A building component in the form of an inflatable cushion, comprising:

at least two sheets of plastics foil;

a relatively rigid frame surrounding and supporting the foil sheets;

a bead formed around a periphery of the two sheets of plastic foil and disposed within the relatively rigid frame; and a release mechanism comprising an electrical resistance cable arranged to melt on demand the periphery of the two sheets of plastics foil to thereby release the inflatable cushion from the bead disposed within the frame.

2. The building component as claimed in claim 1, wherein the sheets comprise ethylene tetrafluoro ethylene (ETFE).

3. The building component as claimed in claim 1, wherein two of the sheets each have a respective perimeter and define a space between them which space is inflated with air, and wherein the frame restrains the sheets about their perimeters, thereby forming the inflatable cushion.

4. The building component as claimed in claim 3, wherein the release mechanism extends around an entire periphery of the inflatable cushion.

5. A cladding system for a building having a structure, comprising:

a plurality of building components each in the form of an inflatable cushion comprised of at least two sheets of plastics foil;

a relatively rigid frame surrounding and supporting the foil sheets attached to the structure;

a bead formed around a periphery of each inflatable cushion and disposed within the relatively rigid frame; and a release mechanism comprising an electrical resistance cable arranged to melt on demand the periphery of each inflatable cushion, thereby releasing the inflatable cushion from its respective bead disposed within the frame.

* * * * *